United States Patent [19]

Castle

[11] Patent Number: 4,549,377

[45] Date of Patent: Oct. 29, 1985

[54] TWO-PIECE SNAP-LOCK FACIA BORDER

[76] Inventor: Gary M. Castle, 4854 Forster, Schiller Park, Ill. 60176

[21] Appl. No.: 526,004

[22] Filed: Aug. 24, 1983

[51] Int. Cl.[4] ..... E04B 7/09

[52] U.S. Cl. ..... 52/94

[58] Field of Search ..... 52/94–96, 52/732, 58–62

[56] References Cited

U.S. PATENT DOCUMENTS

| | | | |
|---|---|---|---|
| 4,155,203 | 5/1979 | Wolma | 52/94 |
| 4,241,549 | 12/1980 | Hall et al. | 52/94 |
| 4,404,777 | 9/1983 | Lolley et al. | 52/94 |
| 4,419,850 | 12/1983 | Butzen | 52/60 |

*Primary Examiner*—James L. Ridgill, Jr.

*Attorney, Agent, or Firm*—Lee, Smith & Zickert

[57] ABSTRACT

A two-piece snap-lockable facia border for use around the peripheral edge of a flat-roofed building structure. A base member of the border includes a raised box-like enclosure defining a compressive engagement structure, and a fastening strip for fastening the base member to the respective top and side corner surfaces of the roof is provided on each elongate side thereof. One fastening strip depends from the box-like enclosure so as to be fastenable to the side surface of the structure, includes an engagement skirt angled slightly outwardly from the bottom thereof. A cap member of the facia border is complementarily shaped as the base member so that when snap-locked thereover layered roofing material can be compressively anchored therebetween. The cap member includes a rounded edge engageable with a side wall of the box-like enclosure, and along the opposing edge of the cap member a hooked edge is engageable with the base member engagement skirt.

8 Claims, 4 Drawing Figures

TWO-PIECE SNAP-LOCK FACIA BORDER

BACKGROUND OF THE INVENTION

The present invention relates in general to an improved facia border for use around the periphery of a building roof, and in particular to a facia border for use on flat-roofed structures.

A special need arises in flat-roofed structures for facia borders which are adapted for anchoring roofing sheet material without puncturing the material, and for providing a gravel stop to contain the rock composition overlying the sheet material, when used. The roofing industry has experienced a great deal of advancement in the development of roofing materials which have an extended life and which are resistant to extreme environmental conditions. According to current construction techniques, metallic facia borders are utilized to anchor the roofing sheet material around the peripheral edge of the roof, as well as in many cases provide a boundary for containing the gravel overlay. Because a primary aim of a high quality roofing sheet material is to prevent the leakage of water, it is counterproductive to utilize facia border elements which have a tendency to puncture the material during installation or expose of the sheet material to sharp edges of the facia border.

One type of facia border which has enjoyed moderate success is described in U.S. Pat. No. 4,071,987 by Hickman. With this construction, however, the top metallic edge of the facia anchor can easily pierce the roofing sheet material. Moreover, the Hickman facia border is not a rigid unit when installed and thus any horizontal pressure on the unit by ladders or by workmen stepping on the it will either stretch or wrinkle the sheet material, or weaken it to the extent that leakage becomes a possibility.

Another attempt to provide an answer to facia problems on flat-roofed buildings is described in U.S. Pat. No. 3,405,485 by Edwards. While this type of facia border may be effective, it suffers the disadvantage that the completed structure is comprised of many complex-shaped pieces. As a result, installation becomes complex and time consuming, thereby increasing material and labor costs. With this arrangement, the elongate edge of the complex-shaped counterflashing element engages the roofing sheet material and increases the chance of puncturing or piercing the material.

Other varieties of facia borders include U.S. Pat. No. 4,155,203 by Wolma which discloses a rigid structure, but which anchors the roofing sheet material by pinching, and thus partially puncturing the sheet material. U.S. Pat. No. 3,012,376 by Reddy et al. shows a facia border with a coping member which is easily snap-lock installed, but which lacks the ruggedness and rigidity necessary for commercial use.

With the foregoing in mind, it is seen that there is a need for a facia border which can be easily constructed, easily installed and is rugged and rigid. Of paramount importance, there is a need for a facia border which anchors the roofing material in such a way as to eliminate any possibility of rupturing, puncturing, or stretching the sheet material.

SUMMARY OF THE INVENTION

In accordance with the invention there is provided a two-piece roof facia assembly which is snap-lockable together to sandwich therebetween and anchor layered roofing materials.

A base member of the assembly is constructed of sheet metal with a box-like enclosure protruding above the roof level to provide a structure to which a cap member is compressively fitted. On one side of the box-like enclosure the sheet metal extends outwardly to provide a strip for fastening the base member to the roof top. On the opposing side of the box-like enclosure the sheet metal extends downwardly thereby providing a strip for attachment to the facade side of the roof. In this manner the box-like enclosure provides a rigid structure over which the roofing sheet material may be wrapped, and which has suitable strength on which workmen may walk or ladders may be supported.

The base member includes two engagement surfaces to which a cap member of the assembly is compressibly snap-locked, thereby sandwiching and anchoring the roofing sheet material therebetween. For ease of description herein the various cap member surfaces are described as being engageable with corresponding surfaces of the base member. It should be understood at the outset, however, that such engagement is not by physical contact but rather through the layered sheet material which lies therebetween.

The first engaging surface on the base member is comprised of one vertical side of the box-like enclosure which is angled inwardly and downwardly forming a side wall over which a lip of the cap member can be engaged. The other engaging surface of the base member is located at the marginal edge of the downwardly depending fastening strip which is flared outwardly at an acute angle to form a skirt.

The general cross-sectional configuration of the cap member of the assembly is complementary to that of the base member to allow the cap member to be compressibly held against the outer surface of the base member once permanently snap-locked thereto. Engaging surfaces located at the opposing edges of the cap member are each engageable with a respective engaging surface on the base member.

Specifically, the top edge of the cap member includes an inwardly and downwardly disposed lip which engages with the corresponding inwardly and downwardly disposed wall of the box-like enclosure thereby preventing upward movement of the cap member. Once the top edge of the cap member is engaged, the bottom edge thereof, which is bent outwardly and then inwardly to form a hook, is pivoted downwardly so that it snaps over the skirted marginal edge of the base member. With this arrangement the two members of the facia assembly are permanently snap-locked together.

DETAILED DESCRIPTION OF THE PREFERRED EMBODIMENT

Figure 1:
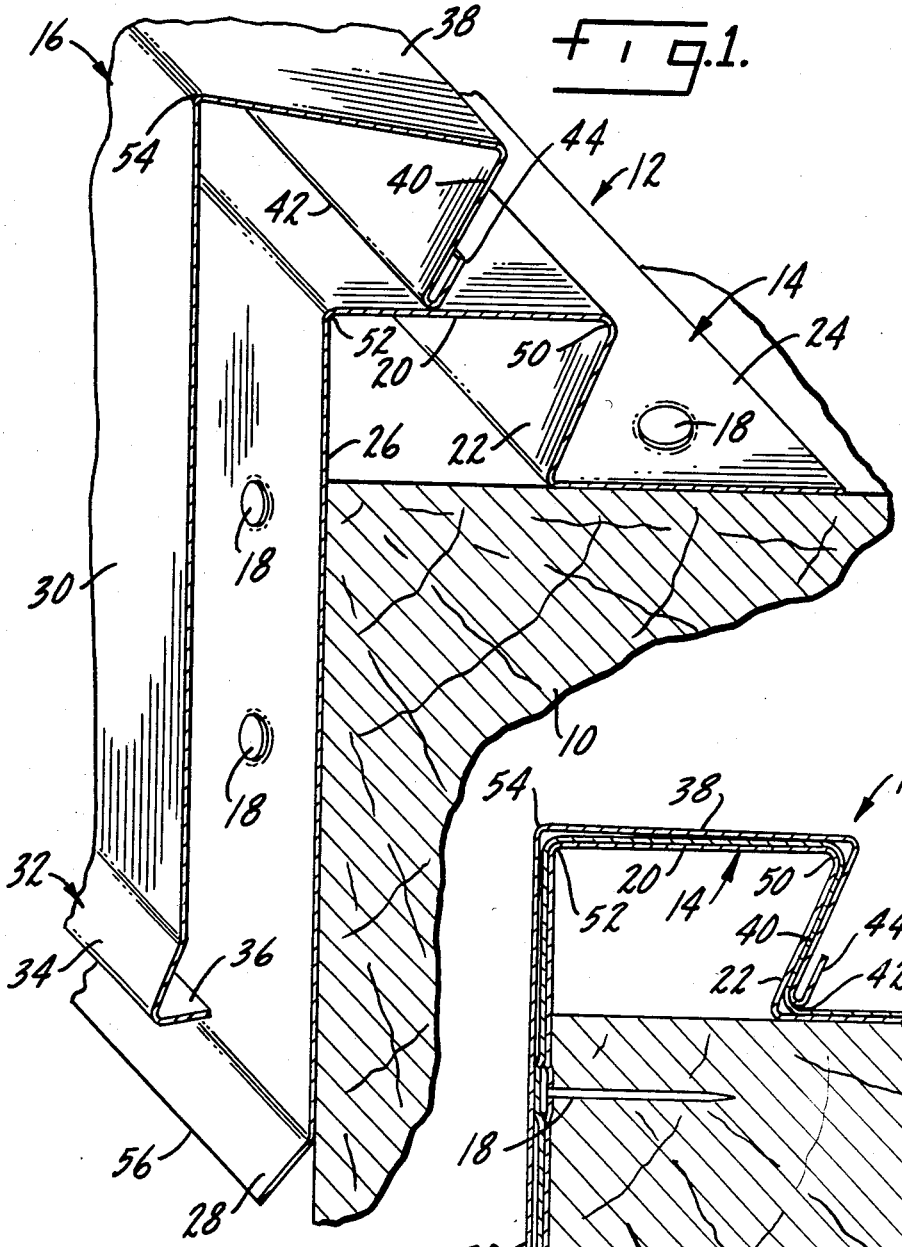
FIG. 1 is an isometric view of the facia assembly accoring to the invention, illustrating the facia base member fastened to the peripheral edge of a building, and the cap member prior to installation.

According to the principles of the present invention, the two-piece building facia assembly is shown in FIG. 1. The facia assembly has particular utility when used in conjunction with flat-roofed structures, and will thus be described in that environment.

FIG. 1 shows the roof corner 10 of a building structure to which a facia base member 14 is attached. The corner 10 is depicted as a wood nailer, however the applicability of the invention is not limited to such type of building corner. The facia assembly, generally designated 12, is comprised of a base member 14 and a cap member 16. The base member 14 can be easily and quickly fastened to the building roof corner 10 by suitable means, such as by roofing nails 18. For ease of manufacture, the assembly 12 members are preferably constructed of light gauge sheet metal. Because the base member is rigidly fixed to the building roof corner 10, it can be constructed of a lighter gauge material than the cap member 16. Gauges of sheet metal material may be selected to provide adequate strength for the assembly while allowing the nails 18 to be driven into the roof corner 10 and indent the metal slightly around the nail head so as to be flush with the metal surface. Other than conventional carpenter tools needed for fastening the base member 14 to the roof corner 10, the installation of the facia assembly 12 requires no other specialized tools.

The base member 14 is elongate and can be constructed in a conventional fashion from sheet metal materials. Because the structure of the facia assembly 12 requires no complicated angular bends, both the base member 14 and the cap member 16 can be easily constructed by press brake or roll forming processes. During formation of the base member 14 a raised box-like enclosure 20 is formed intermediate the elongate edges of the member. This box-like enclosure 20, which is trapezoidal in the preferred embodiment, protrudes sufficiently above the surface of the roof corner 10 to provide a structure over which the cap member is compressively fitted. The box-like enclosure 20 may also act as a curb when used in conjunction with gravel-type overlays. It is contemplated that the present invention will be highly advantageous in roofing applications utilizing single-layer materials over which no tar or gravel composition is laid.

As will be discussed in more detail below, the box-like enclosure 20 includes a side wall 22 which is formed downwardly and inwardly to provide an engaging surface for snap-locking the cap member 16 thereto. Because of the box-like enclosure 20, the base member 14 becomes a rigid structure once it is fastened to the roof corner 10 and thus is highly resistent to damage frequently occasioned by ladders, roofing equipment, or workers stepping thereon.

Adjacent the box-like enclosure 20 of the base member 14, there is a horizontally-disposed fastening strip 24 through which the facia base member 14 is fastened to the top part of the roof corner 10. A vertical fastening strip 26 of the facia base member 14 depends downwardly, is flush with the outer side of the roof corner 10 and is fastened thereto as shown. At the marginal edge of the downwardly depending fastening strip 26 there is formed an engagement skirt 28 flared outwardly at an acute angle. As will be set forth in more detail below, the engagement skirt 28 provides an edge over which a facia cap member 16 can be snapped to lock the assembly members together. An angle of about 40 degrees between the engagement skirt 28 and the fastening strip 26 has been found satisfactory to effect a reliable engagement of the members.

In addition to the provision of a box-like enclosure 20, the facia base member 14 provides a continuous smoothly curved surface over which the layered roofing material (not shown in FIG. 1) may be laid and anchored to the roof corner by snap-locking the cap member 16 thereover. The layered building material (identified by reference character 46 in FIG. 2) is thus compressively sandwiched between the assembly members 14 and 16 and thereby anchored at the building roof corner 10. In accordance with one feature of the invention the manner in which the layered roofing material 46 is anchored by the present invention also eliminates the chance of puncturing the material, a problem prevalent in prior art facia borders. It is seen that the facia assembly members 14 and 16 have no sharp edges or protrusions which contact the layered material as it is disposed therebetween.

In the initial covering, or recovering of a roof, the single sheet roofing material 46 is rolled out on the roof, over the box-like enclosure 20, and partially down onto the depending fastening strip 26. The roofing sheet material 46 may then be tucked fully into the recess formed by the inwardly and downwardly disposed side wall 22.

The facia cap member 16 is constructed to provide a means, when snap-locked to the base member 14, to anchor the roofing sheet material 46, as well as provide an aesthetically pleasing border around the peripheral roof edge of the structure. Thus, the cap member 16 is exposed to the environment and is preferably coated with a material which resists oxidation and which is color coordinated with the structure. Because the cap member 16 snap-locks onto the outer surface of the base member 14, the cap member 16 is complementarily shaped as the base member 14. The cap member 16 includes a facade surface 30 which constitutes the major portion of the facia assembly 12 which is visible. At the bottom marginal edge thereof a hooked edge 32 is formed along the entire edge of the cap member 16, and is engageable with the engagement skirt 28 of the base member 14. The inwardly bent hooked edge 32 of the cap member 16 includes legs 34 and 36.

Because the roofing sheet material 46 exits the facia assembly 12 proximate a lip edge 42 of the cap member 16, such lip edge 42 includes an upturned section 44 thereby eliminating an edge which otherwise might be capable of piercing or puncturing the roof material. In order to assure that the roofing sheet material is compressibly anchored between the facia base member 14 and cap member 16, the cap member 16 is constructured of a stiffly resilient material to maintain its snap-lock engagement on the base member 14. With this arrangement, the cap member 16 cannot be inadvertently disengaged by ladders, tools or high velocity winds.

While the angle of the fastening strip 26 of the base member 14 is about 90° with respect to the top of the box-like enclosure 20, the corresponding angle on the cap member 16 is about 80°, the significance of which will be set forth more fully below. The angle between the top 38 of the cap member 16 and the lipped engagement edge 41 is substantially equal to the angle of the corresponding rounded corner on the base member 14.

Figure 2:
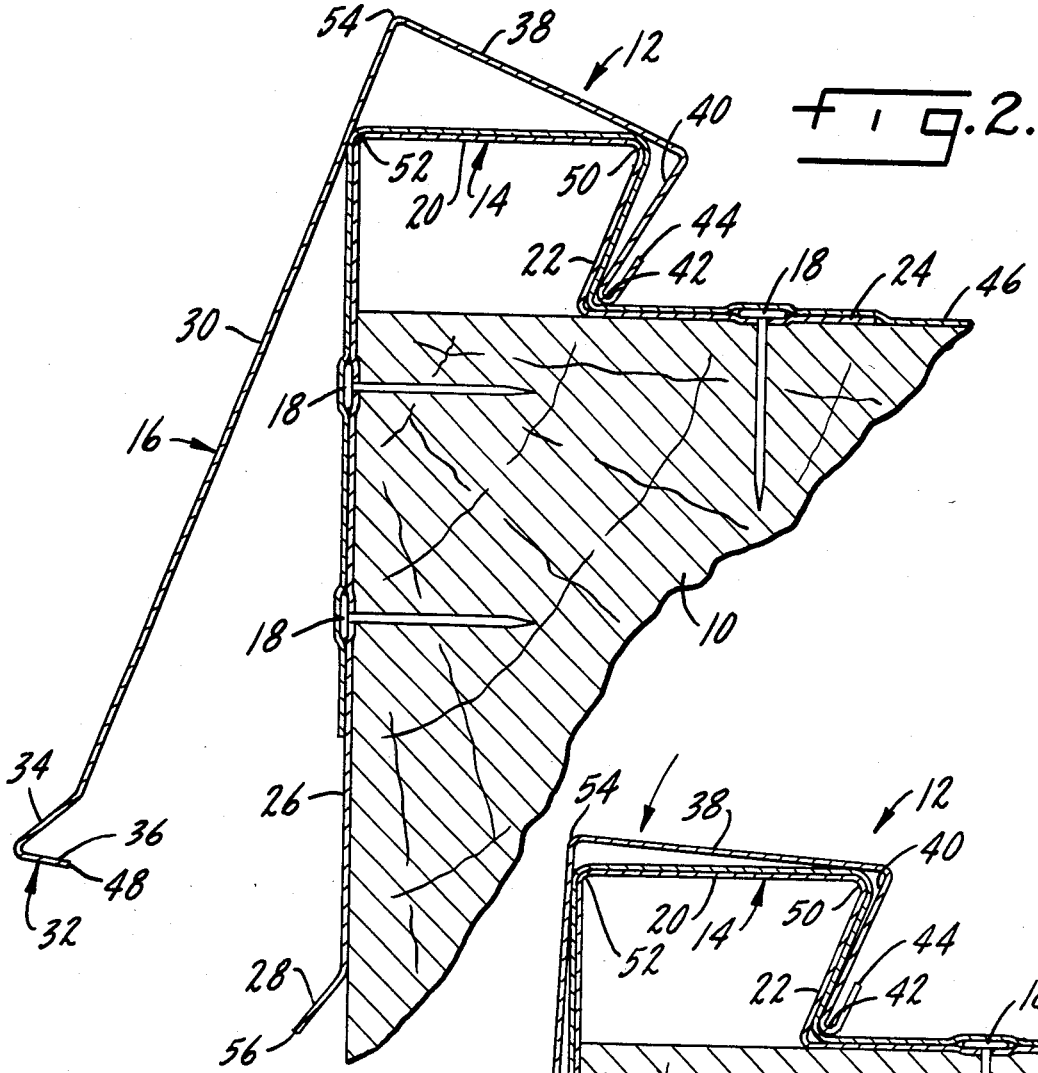

Turning now to FIG. 2 of the drawings there is illustrated the first step in anchoring the roofing sheet material 46 between the facia base member 14 and the cap member 16. The sheet material 46 is wrapped around the rounded corners 50 and 52 of the base member 14 and partially down the downwardly depending fastening strip 26. Once the sheet material 46 is installed in an overlapping position on the base member 14, the cap member 16 is positioned thereover as shown in FIG. 2. Generally, the installation of the assembly members 14 and 16 is accomplished by first positioning the rounded lip edge 42 of the cap member 16 in contact with the base member side wall 22, and rotating the cap member 16 counterclockwise until it reaches the quasi-locking position shown in FIG. 3. It should be understood that as the pivotal movement of the facia cap member 16 moves from the FIG. 2 position to the FIG. 3 position it effectively passes through an "over the center" position. This is due to the compressive fit between the complementary shaped cap member 16 and base member 14.

This step of the installation may be easily accomplished by a workman stationed on the roof top, and thus without the need of scaffolding or the like. In other words, a worker can simply lay the cap member 16 on top the base member 14, over which the roofing sheet material 46 has been laid, and single-handedly effect the initial cap member 16 rotation by hand or foot. It is also seen that the rotational movement of the cap member 16 with respect to the base member 14 is in a direction which tends to maintain the roofing sheet material 46 in the position in which it was laid and thus prevent any gathering or wrinkling of the material proximate the lip edge 42 of the cap member 16. The position of the cap member 16, relative to the base member 14, where the edge 48 of the cap member hooked edge 32 contacts the upper surface of the engagement skirt 28 is a stable engaged position, although not a snap-lock position. By this it is meant that the cap member 16 is temporarily compressively held to the base member 14 for initially anchoring the roofing sheet material 46 therebetween. In other words, with the positional arrangement of the facia members 14 and 16 shown in FIG. 3, the sheet material 46 is firmly anchored, however, if it desired to rearrange, remove, or otherwise move the roofing sheet material 46 the anchor hold can be released by simply counter-rotating the cap member 16 upwardly. Thus, the entire roofing sheet material 46 can be initially laid out on the roof and held there without permanently locking the facia members 14 and 16 together.

Figure 3:
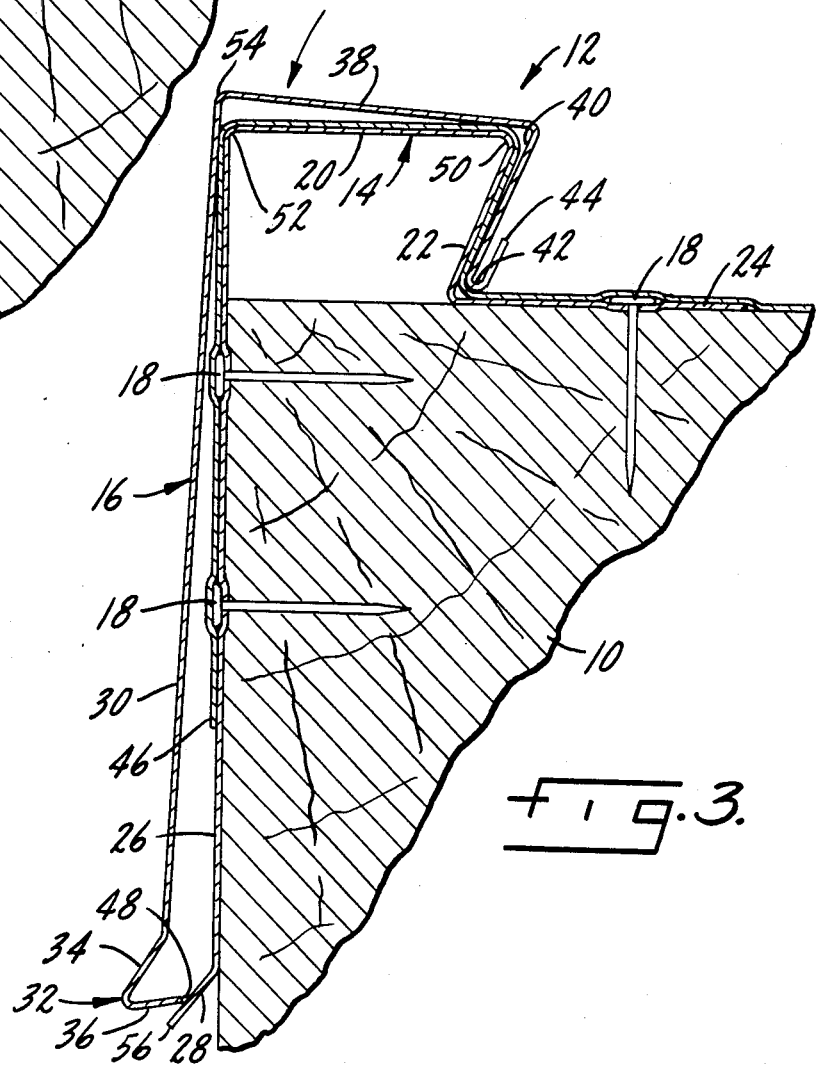

Because the angle between the cap member top 38 and depending facade 30 is less than 90°, and because of its resiliency, such member is compressively held to the base member 14 near corners 52 and 50, edge 48 and near the lip edge 42 (FIG. 3).

When it is determined that further rearrangement of the roofing sheet material is unnecessary, the facia cap member 16 can be further rotated downwardly and permanently snap-locked to the base member 14. This final installation step is accomplished by simply applying pressure to the cap member 16 near its corner 54 (FIG. 3). Because of the cross-sectional configuration of the cap member 16 the vertical space under corner 54 between the cap member 16, and the sheet material 46 is sufficient to allow edge 48 of the cap member hooked edge 32 to move downwardly and slide over edge 56 of the engagement skirt 28 as downward pressure is applied at corner 54. The hooked edge 32 of the cap member 16 can be snap-locked over edge 56 of the base member engagement skirt 28 by simply applying pressure near corner 54 on the cap member 16 progressively along the length of such member 16. In this manner, the cap member 16 can be progressively snap-locked by one person to the base member 14 to form an integral unit for anchoring the roofing sheet material 46.

Figure 4:
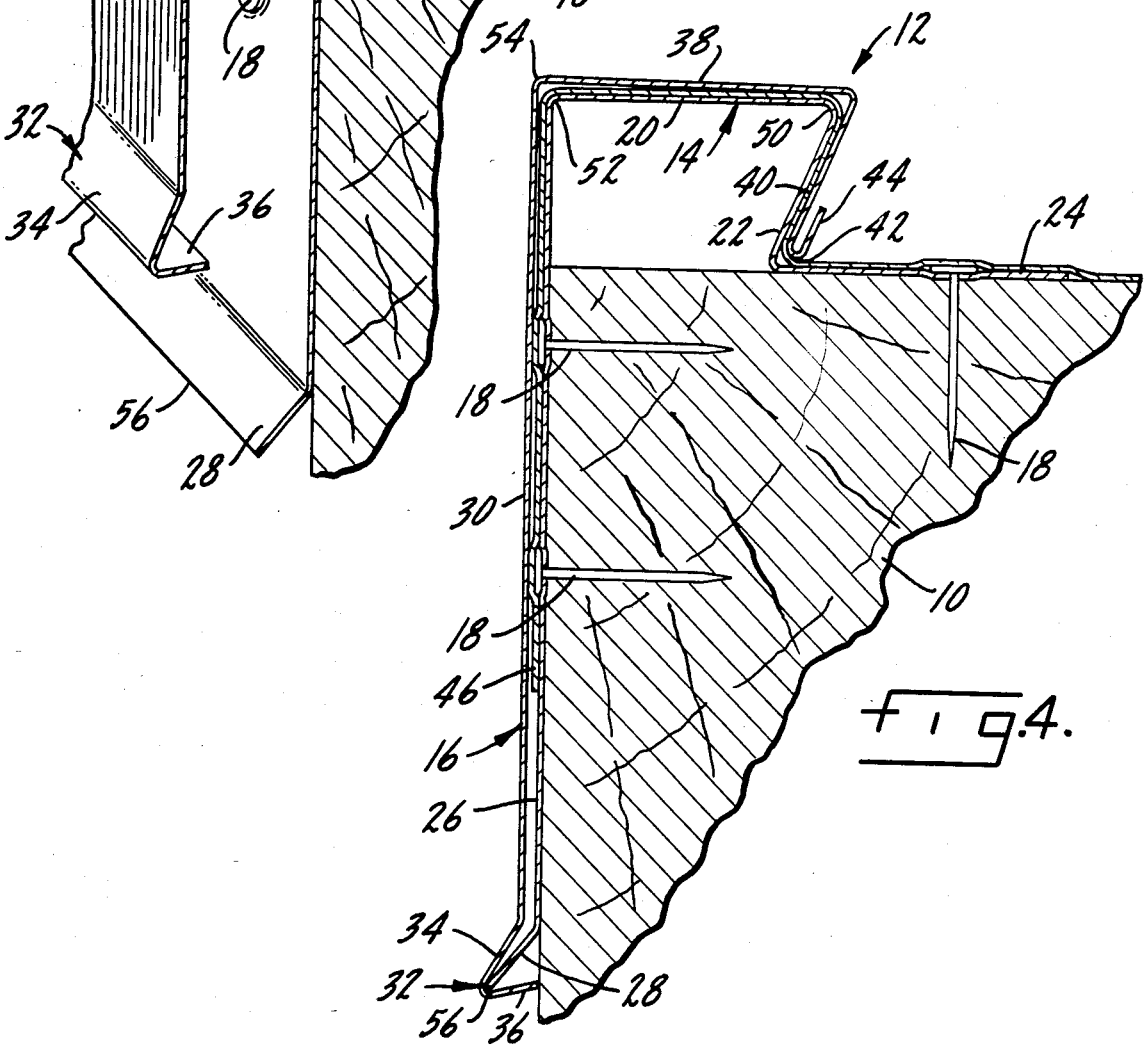
FIGS. 2–4 are cross-sectional side views of the facia assembly members in various positions during the various progressive stages of installation.

FIG. 4 shows the facia cap member 16 permanently snap-locked to the base member 14. The cap member 16, being complementarily shaped as the base member 14, allows the roofing sheet material 46 to be compressively sandwiched between the adjacent the metal surfaces of the facia assembly members 14 and 16 and anchored along much of the surface area thereof, rather than being anchored by the pressure of a metallic edge which increases the chances of puncturing the material. When finally installed, the bottom leg 36 of the hooked edge 32, being angled upwardly, maintains engagement of the base member skirt edge 56 within the hooked edge 32.

Because the bottom leg 36 of the hooked edge 32 is also angled slightly upwardly, it allows the facade surface 30 to raise slightly during final installation as such leg 36 slides upwardly over engagement skirt edge 56. Cap member top 38 is then raised slightly but is of no consequence since the bend angle between the cap facade surface 30 and top 38 is less than the corresponding corner angle of the box-like enclosure 20, and thus any subsequent downward pressure on the cap member top 38 will not inadvertently cause the hooked edge 32 to become disengaged from the engagement skirt 28.

Although the invention has been described above with a certain degree of particularity, it should be understood that the disclosure has been made by way of example only. Consequently, numerous changes may be apparent to those familiar with the art, and may be resorted to without departing from the scope of the invention as claimed below.

What is claimed is:

1. A two-piece facia border attachable to the peripheral edge of a roof structure for anchoring layered roofing material thereto, comprising:

an elongate base member attachable to said roof structure and having an engaging box-like portion, said box-like portion including a side surface angled downwardly and inwardly into said box-like portion toward an opposite side surface of said box-like portion, and said base member further having a first fastening means for attachment to the top of said roof structure and a second fastening means for attachment to the side of said roof structure, said second fastening means having an engaging means along a marginal edge thereof;

an elongate cap member having a top portion thereof pivotally fittable over said box-like portion in an over the center manner so as to be compressibly fittable on said box-like portion for sandwiching therebetween said roofing material, the top portion of said cap member having a downwardly and inwardly depending leg corresponding to an angled side surface of said box-like portion, said leg being angled toward an opposite leg of said cap member, and which leg includes a rounded edge engageable with said side surface of said box-like portion, said cap number further including an engagement means for captive engagement with the engaging means of said second fastening means.

2. The two-piece facia border of claim 1 wherein said first and second fastening means are comprised of a respective first and second fastening strip.

3. The two-piece facia border of claim 1 wherein the marginal edge of said cap member is disposed a substantial distance from said box-like portion to thereby serve as said second fastening means.

4. A facia border for use on the peripheral edge of a roof structure for anchoring sheet-like roofing material, comprising:

an elongate base member attachable to a roof structure, said member including opposing elongate edges between which is formed an elongate raised enclosed portion having an outer surface area around which said sheet material is wrapped, said raised enclosed portion having a side surface angled downwardly and inwardly into said raised enclosed portion toward an opposite side surface of said box-like portion, a first fastening strip adjacent one elongate edge for attachment to a horizontally disposed portion of said structure, a second fastening strip adjacent the other elongate edge for attachment to a vertically disposed portion of said structure whereby said enclosed portion when attached to said structure remains rigid with respect to said structure, said second fastening strip including engagement means proximate said other elongate edge;

an elongate cap member fittable around the other surface of said base member and having a cross-sectional shape complementary to that portion of said base member having opposing elongated edges one of which includes means for engaging a side surface of said raised enclosed portion, and the other edge of which includes means for engaging said engagement surface proximate the marginal edge of said base member.

5. The facia border of claim 4 wherein said one cap member elongate edge engageable with said raised portion is bent outwardly and turned back on itself forming a rounded edge.

6. The facia border of claim 4 wherein the enclosed portion of said elongate member is trapezoidal in cross-section.

7. The facia border of claim 6 wherein said box-shaped enclosed portion includes a top flat surface adjacent said second fastening strip defining a corner with a given inside angle, and said cap member includes a corresponding corner with a smaller inside angle, whereby said cap member is compressively engaged onto said base member when fitted thereover.

8. A two-piece facia border assembly for use with roof structures comprising:

an elongate base member having an elongate portion raised above the roof level to thereby define a hollow enclosure, said enclosure having a pair of elongate fastening strips for rigidly fastening said base member of said roof structure;

an elongate cap member portion compressibly fittable over the hollow enclosed portion of said base member, and proximate the other elongate edge thereof means for captively engagement with said fastening strip, said hollow enclosure including, a side wall angled downwardly and inwardly toward the inner part of said enclosure toward an opposite side wall of said hollow enclosure thereby facilitating the compressive fit of said cap member to said base member.

* * * * *